US011764451B2

(12) United States Patent
Tarng et al.

(10) Patent No.: US 11,764,451 B2
(45) Date of Patent: Sep. 19, 2023

(54) WAVEGUIDE STRUCTURE

(71) Applicant: Subtron Technology Co., Ltd., Hsinchu County (TW)

(72) Inventors: Jenn-Hwan Tarng, Hsinchu County (TW); Nai-Chen Liu, Hsinchu County (TW); Yin-Kai Lin, Hsinchu County (TW); Tsung-Han Lee, Hsinchu County (TW); Chao-Wei Chang, Hsinchu County (TW)

(73) Assignee: Subtron Technology Co., Ltd., Hsinchu County (TW)

( * ) Notice: Subject to any disclaimer, the term of this patent is extended or adjusted under 35 U.S.C. 154(b) by 348 days.

(21) Appl. No.: 17/152,800

(22) Filed: Jan. 20, 2021

(65) Prior Publication Data

US 2021/0384618 A1 Dec. 9, 2021

(30) Foreign Application Priority Data

Jun. 4, 2020 (TW) ..... 109118801

(51) Int. Cl.
*H01P 3/12* (2006.01)
*H01Q 1/38* (2006.01)
(Continued)

(52) U.S. Cl.
CPC ..... *H01Q 1/38* (2013.01); *H01P 1/207* (2013.01); *H01P 3/121* (2013.01); *H01Q 1/50* (2013.01)

(58) Field of Classification Search
CPC ..... H01Q 1/38; H01Q 1/50; H01Q 9/0457; H01P 1/20; H01P 3/12; H01P 1/207;
(Continued)

(56) References Cited

U.S. PATENT DOCUMENTS 6,064,350 A * 5/2000 Uchimura ..... H01Q 21/064 343/742
2003/0189469 A1 10/2003 Snyder et al.
(Continued)

FOREIGN PATENT DOCUMENTS

CN 101567356 10/2009
CN 101778531 7/2010
(Continued)

OTHER PUBLICATIONS

Zhang et al, "Design of microstrip waveguide transition with sealing", Journal of Xi'an University of Posts and Telecommunications vol. 21 No. 4 Jul. 2016.
(Continued)

*Primary Examiner* — David E Lotter
(74) *Attorney, Agent, or Firm* — JCIPRNET

(57) ABSTRACT

A waveguide structure includes a dielectric layer, a plurality of circuit layers, a plurality of insulation layers, and a conductor connection layer. The dielectric layer has an opening. The circuit layers are disposed on the dielectric layer. The insulation layers and the circuit layers are alternately stacked. The conductor connection layer covers an outer wall of the opening in a direction perpendicular to the circuit layers and connects at least two circuit layers on two opposite sides of the opening. At least the conductor connection layer and a part of the circuit layers define an air cavity for transmitting signals at a position corresponding to the opening.

8 Claims, 8 Drawing Sheets

(51) Int. Cl.
*H01P 1/207* (2006.01)
*H01Q 1/50* (2006.01)

(58) Field of Classification Search
CPC .. H01P 3/121; H01P 5/028; H01P 3/18; H01P 1/2088
See application file for complete search history.

(56) References Cited

U.S. PATENT DOCUMENTS

| | | | | |
|---|---|---|---|---|
| 2011/0140979 | A1* | 6/2011 | Dayan | H01P 3/121 333/208 |
| 2014/0287702 | A1* | 9/2014 | Schuppener | H01Q 9/065 333/260 |
| 2015/0035714 | A1 | 2/2015 | Zhou | |
| 2016/0293557 | A1 | 10/2016 | Topak et al. | |
| 2016/0351984 | A1 | 12/2016 | Jensen et al. | |

FOREIGN PATENT DOCUMENTS

| | | |
|---|---|---|
| CN | 209150308 | 7/2019 |
| CN | 209913007 | 1/2020 |
| DE | 102010036820 | 5/2015 |
| EP | 0893842 | 5/2004 |
| TW | 201721960 | 6/2017 |
| TW | 201724638 | 7/2017 |
| WO | 2018209422 | 11/2018 |

OTHER PUBLICATIONS

"Office Action of Taiwan Counterpart Application", dated Mar. 16, 2021, pp. 1-3.
"Notice of allowance of China Counterpart Application", dated Sep. 15, 2022, p. 1-p. 4.
"Office Action of China Counterpart Application", dated Mar. 29, 2022, p. 1-p. 7.
"Search Report of Europe Counterpart Application", dated Nov. 5, 2021, p. 1-p. 8.

* cited by examiner

WAVEGUIDE STRUCTURE

CROSS-REFERENCE TO RELATED APPLICATION

This application claims the priority benefit of Taiwan application serial no. 109118801, filed on Jun. 4, 2020. The entirety of the above-mentioned patent application is hereby incorporated by reference herein and made a part of this specification.

BACKGROUND

1. Technical Field

The disclosure relates to a semiconductor structure, and in particular, to a waveguide structure.

2. Description of Related Art

At present, substrate integrated waveguide (SIW) structures are used in high-frequency circuits most of the time. In a cross-sectional view, the SIW consists of a dielectric material, upper and lower metal surfaces located on two opposite surfaces of the dielectric material, and a copper pillar penetrating through the dielectric material and connecting the upper and lower metal surfaces. However, in the above structure, the dielectric material covered by the upper and lower metal surfaces and the copper pillar may lead to energy loss during signal transmission. Particularly, when the frequency increases, such loss increases. Therefore, selection of dielectric materials is often limited by the dissipation factor (DF), and costs of circuit implementation are thereby increased.

SUMMARY

The disclosure provides a waveguide structure having an air cavity for transmitting signals, such that energy loss during signal transmission is decreased, high average power handling is provided, and the waveguide structure is not affected by dielectric materials outside the air cavity.

The waveguide structure of the disclosure includes a dielectric layer, a plurality of circuit layers, a plurality of insulation layers, and a conductor connection layer. The dielectric layer has an opening. The circuit layers are disposed on the dielectric layer. The insulation layers are alternately stacked with the circuit layers. The conductor connection layer covers an outer wall of the opening in a direction perpendicular to the circuit layers and connecting at least two of the circuit layers located on two opposite sides of the opening. At least the conductor connection layer and a part of the circuit layers define an air cavity for transmitting signals at a position corresponding to the opening.

In an embodiment of the disclosure, the dielectric layer has a first surface and a second surface opposite to each other. The circuit layer includes a first inner circuit layer, a second inner circuit layer, a first build-up circuit layer, and a second build-up circuit layer. The insulation layer includes a first insulation layer and a second insulation layer. The conductor connection layer connects the first inner circuit layer and the second inner circuit layer.

In an embodiment of the disclosure, the first inner circuit layer is disposed on the first surface of the dielectric layer. The first insulation layer is located between the first build-up circuit layer and the first inner circuit layer. The first insulation layer includes a first opening in communication with the opening. The second inner circuit layer is disposed on the second surface of the dielectric layer. The second insulation layer is located between the second build-up circuit layer and the second inner circuit layer. The second insulation layer includes a second opening in communication with the opening. An inner wall of the first opening and an inner wall of the second opening are flush with the conductor connection layer. The first build-up circuit layer extends to cover the first opening, and the second build-up circuit layer extends to cover the second opening. A part of the first build-up circuit layer, the inner wall of the first opening, the conductor connection layer, the inner wall of the second opening, and a part of the second build-up circuit layer define the air cavity.

In an embodiment of the disclosure, the waveguide structure further includes: a plurality of conductive vias disposed on two opposite sides of the air cavity and penetrating through the first build-up circuit layer, the first insulation layer, the first inner circuit layer, the dielectric layer, the second inner circuit layer, the second insulation layer, and the second build-up circuit layer. The conductive vias electrically connect the first build-up circuit layer, the first inner circuit layer, the second inner circuit layer, and the second build-up circuit layer.

In an embodiment of the disclosure, the first insulation layer and the second insulation layer are located on the first surface and the second surface of the dielectric layer, respectively. The first build-up circuit layer and the second build-up circuit layer cover the first insulation layer and the second insulation layer, respectively. The first insulation layer extends to cover a first part of the opening located between the first inner-layer circuit layer and the first build-up circuit layer. The second insulation layer extends to cover a second part of the opening located between the second inner circuit layer and the second build-up circuit layer. A part of the first build-up circuit layer, a part of the second build-up circuit layer, and the conductor connection layer define the air cavity.

In an embodiment of the disclosure, the first insulation layer is located between the first build-up circuit layer and the first inner circuit layer. The second insulation layer is located between the second build-up circuit layer and the second inner circuit layer. The second build-up circuit layer covers the second surface of the dielectric layer and has a coupling opening in communication with the opening. The conductor connection layer connects the first inner circuit layer, the first build-up circuit layer, and the second build-up circuit layer.

In an embodiment of the disclosure, the circuit layers further include a third build-up circuit layer, and the insulation layers further include a third insulation layer. The third insulation layer covers the second build-up circuit layer, and the third build-up circuit layer covers a part of the third insulation layer. The second build-up circuit layer, the third insulation layer, and the third build-up circuit layer define a microstrip line portion.

In an embodiment of the disclosure, the waveguide structure further includes: a plurality of conductive vias disposed around the air cavity and penetrating through the first build-up circuit layer, the first insulation layer, the first inner circuit layer, the second inner circuit layer, and the second insulation layer. The conductive vias electrically connect the first build-up circuit layer, the first inner circuit layer, the second inner circuit layer, and the second build-up circuit layer.

In an embodiment of the disclosure, the waveguide structure further includes: a feed portion and a protective layer. The feed portion penetrates through the third insulation layer and passes through the coupling opening to electrically connect the first inner circuit layer and the third build-up circuit layer. The protective layer covers a surrounding surface of the feed portion, where the feed portion is electrically insulated from the second build-up circuit layer through the protective layer.

In an embodiment of the disclosure, the waveguide structure further includes: an antenna assembly including at least one antenna element. The insulation layers further include a third insulation layer, and the third insulation layer covers the second build-up circuit layer and has an insulation opening in communication with the opening and the coupling opening. The antenna assembly covers the third insulation layer, and the antenna element is disposed corresponding to the insulation opening. The conductor connection layer connects the first inner circuit layer, the first build-up circuit layer, the second inner circuit layer, and the second build-up circuit layer.

Based on the above, the waveguide structure of the disclosure includes the dielectric layer, the plurality of circuit layers, the plurality of insulation layers, and the conductor connection layer. The dielectric layer, the plurality of circuit layers, and the plurality of insulation layers may be treated as a multi-layer circuit board, and at least the conductor connection layer and a part of the circuit layer may define the air cavity for transmitting signals at the position corresponding to the opening of the dielectric layer. Through the design of the air cavity, energy losses during signal transmission may be reduced. Therefore, the waveguide structure of the disclosure not only exhibits low losses but also features high average power handling and is not affected by dielectric materials outside the air cavity.

To make the features and advantages of the disclosure clear and easy to understand, the following gives a detailed description of embodiments with reference to accompanying drawings.

DESCRIPTION OF THE EMBODIMENTS

Figure 1A:
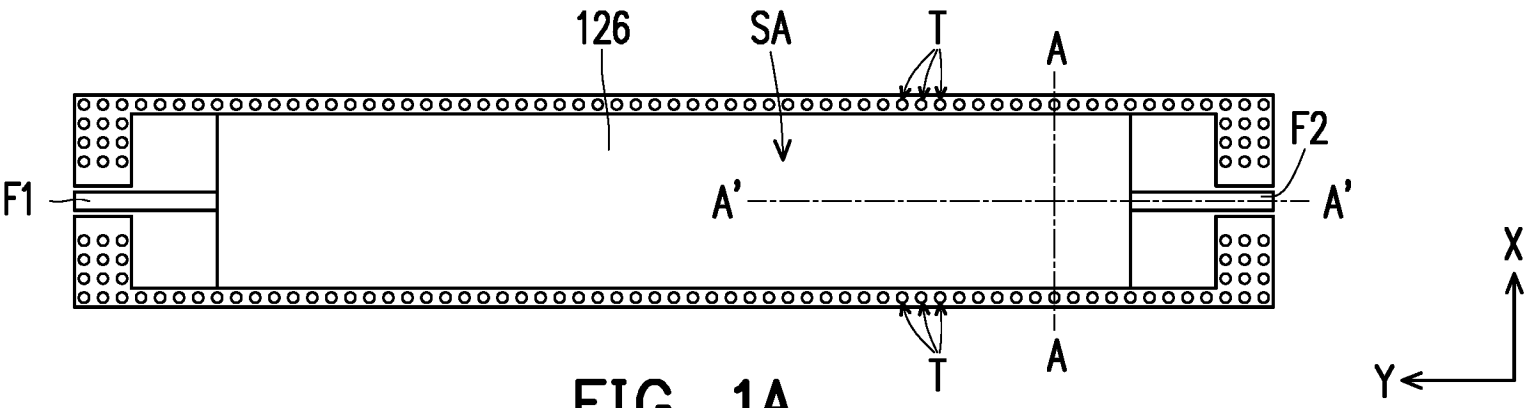
FIG. 1A is a schematic top view of a waveguide structure according to an embodiment of the disclosure.
Figure 1B:
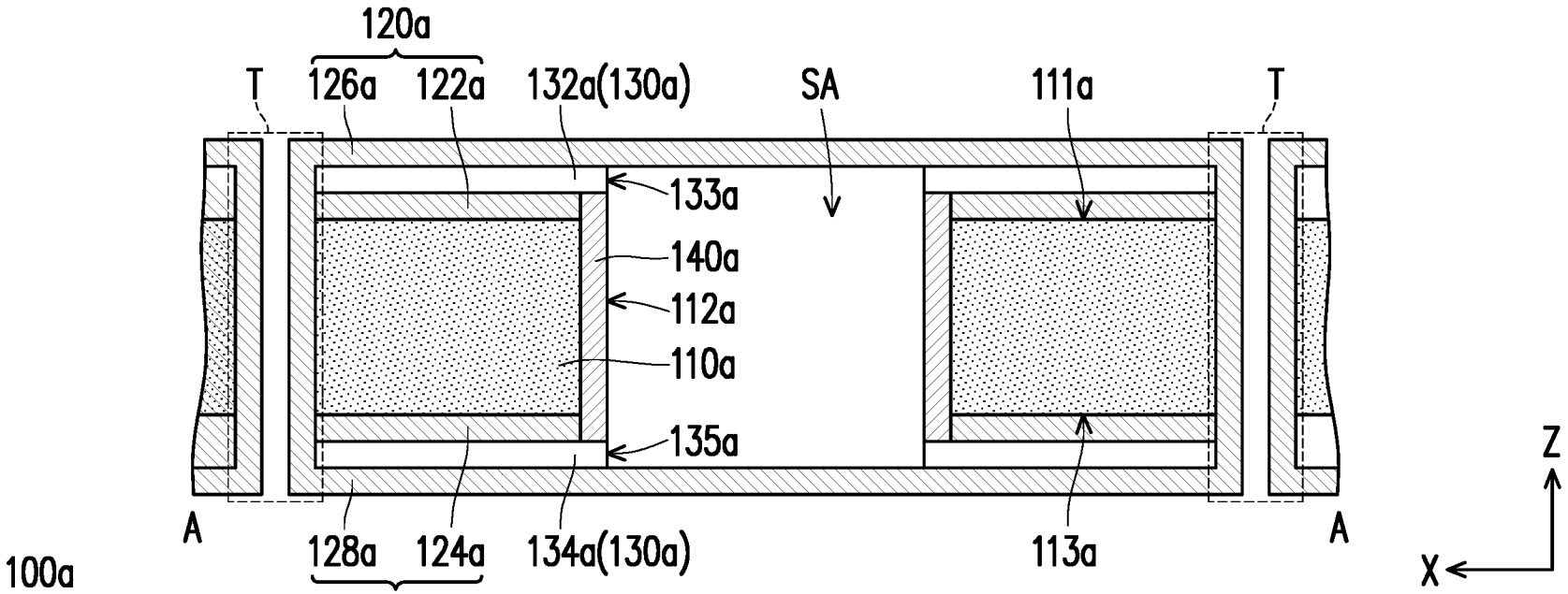
FIG. 1B is a schematic cross-sectional view taken along a line A-A in FIG. 1A.
Figure 1C:
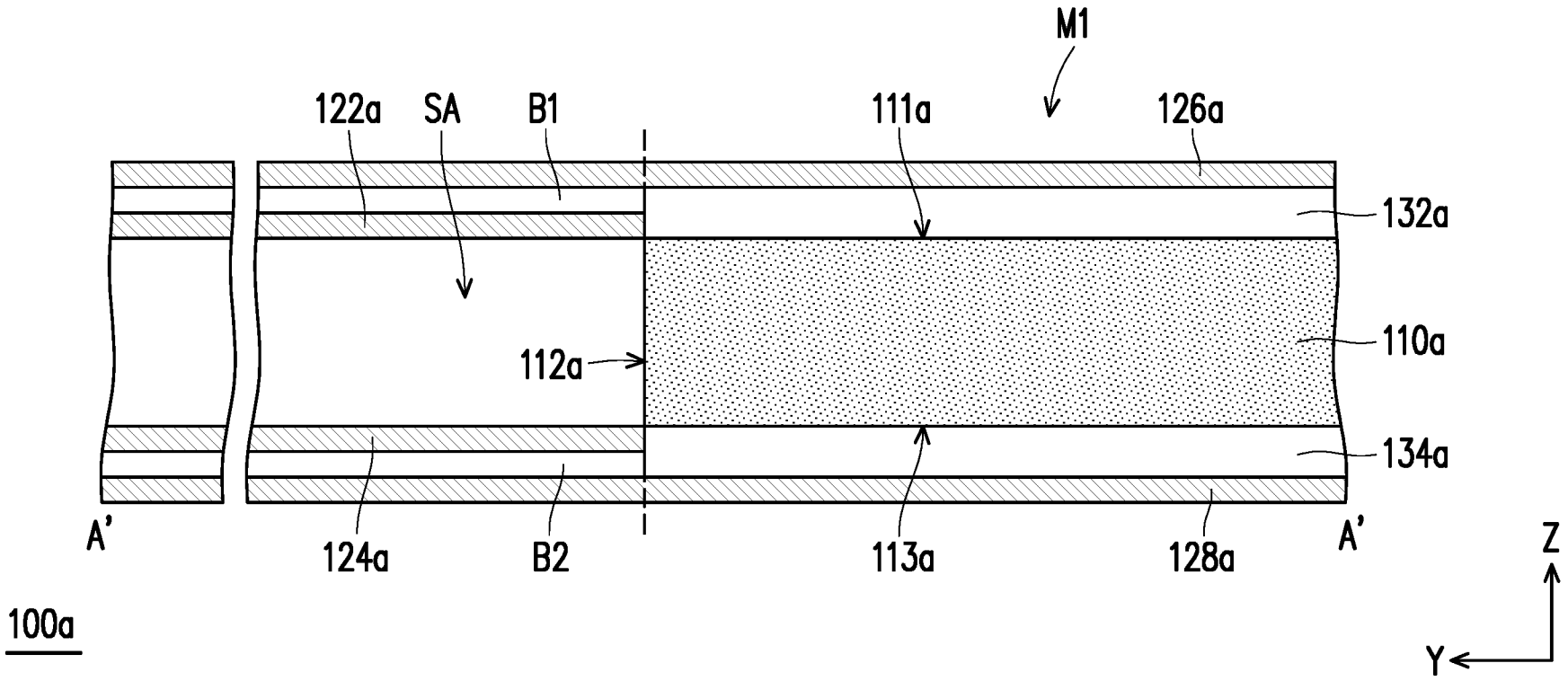
FIG. 1C is a schematic cross-sectional view taken along a line A'-A' in FIG. 1A.

FIG. 1A is a schematic top view of a waveguide structure according to an embodiment of the disclosure. FIG. 1B is a schematic cross-sectional view taken along a line A-A in FIG. 1A. FIG. 1C is a schematic cross-sectional view taken along a line A'-A' in FIG. 1A. Referring to FIG. 1A and FIG. 1B together, in the present embodiment, a waveguide structure 100*a* of the disclosure includes a dielectric layer 110*a*, a plurality of circuit layers 120*a*, a plurality of insulation layers 130*a*, and a conductor connection layer 140*a*. The dielectric layer 110*a* has an opening 112*a*. The circuit layers 120*a* are disposed on the dielectric layer 110*a*. The insulation layers 130*a* are alternately stacked with the circuit layers 120*a*. The conductor connection layer 140*a* covers an outer wall of the opening 112*a* in a direction perpendicular to the circuit layers 120*a* and connects at least two of the circuit layers 120*a* located on two opposite sides of the opening 112*a*. At least the conductor connection layer 140*a* and a part of the circuit layers 120*a* define an air cavity SA for transmitting signals at a position corresponding to the opening 112*a*.

Specifically, the waveguide structure 100*a* in the present embodiment may be applied to high-frequency (for example, microwave and millimeter-wave) wireless communication, an automotive radar system, a 5G communication system, or a satellite communication system, etc., but the disclosure is not limited thereto. The dielectric layer 110*a* is, for example, a core dielectric layer, and has a first surface 111*a* and a second surface 113*a* opposite to each other. The dielectric layer 110*a* has a thickness of, for example, 50 microns, and is made of, for example, a polymer material, but the disclosure is not limited thereto. The circuit layer 120*a* includes a first inner circuit layer 122*a*, a second inner circuit layer 124*a*, a first build-up circuit layer 126*a*, and a second build-up circuit layer 128*a*. The first inner circuit layer 122*a* and the second inner circuit layer 124*a* may have a thickness (for example, 20 microns) greater than thicknesses (for example, 15 microns) of the first build-up circuit layer 126*a* and the second build-up circuit layer 128*a*, but the disclosure is not limited thereto. The first inner circuit layer 122*a* and the second inner circuit layer 124*a* are made of, for example, copper foil, and the first build-up circuit layer 126*a* and the second build-up circuit layer 128*a* are made of, for example, copper, but the disclosure is not limited thereto. The insulation layer 130*a* includes a first insulation layer 132*a* and a second insulation layer 134*a*. The first insulation layer 132*a* and the second insulation layer 134*a* have a thickness of, for example, 25 microns, but the disclosure is not limited thereto.

As shown in FIG. 1B, the conductor connection layer 140*a* in the present embodiment connects the first inner circuit layer 122*a* and the second inner circuit layer 124*a*. The first inner circuit layer 122*a* is on the first surface 111*a* of the dielectric layer 110*a*, and the first insulation layer 132*a* is located between the first build-up circuit layer 126*a* and the first inner circuit layer 122*a*. The first insulation layer 132*a* has a first opening 133*a* in communication with the opening 112*a*. The second inner circuit layer 124*a* is disposed on the second surface 113*a* of the dielectric layer 110*a*, and the second insulation layer 134*a* is located between the second build-up circuit layer 128*a* and the second inner circuit layer 124*a*. The second insulation layer 134*a* has a second opening 135*a* in communication with the opening 112*a*. An inner wall of the first opening 133*a* and an inner wall of the second opening 135*a* are flush with the conductor connection layer 140*a*. The first build-up circuit layer 126*a* extends to cover the first opening 133*a*, and the second build-up circuit layer 128*a* extends to cover the second opening 135*a*. A part of the first build-up circuit layer 126*a*, the inner wall of the first opening 133*a*, the conductor connection layer 140*a*, the inner wall of the second opening 135*a*, and a part of the second build-up circuit layer 128*a* define the air cavity SA. More specifically, the air cavity SA defined in the present embodiment is substantially a hexahedron (such as a cube). Two sides thereof are the conductor connection layer 140*a*, other two sides are an interface between the air cavity SA and the dielectric layer 110*a*, and remaining two sides are the circuit layer.

The stacked dielectric layer 110*a*, circuit layers 120*a*, and insulation layers 130*a* in the present embodiment may be treated as a multi-layer circuit board. In other words, in the present embodiment, a substrate integrated structure with an air cavity SA is implemented through a manufacturing technology for a plurality of circuit layers. Therefore, the waveguide structure 100*a* in the present embodiment may be treated as an empty substrate integrated waveguide (ESIW) structure. Furthermore, a part of the first build-up circuit layer 126*a*, a part of the second build-up circuit layer 128*a*, and the conductor connection layer 140*a* constitute a conductor ring structure with upper, lower, left, and right sides that may be used for signal transmission between elements of the multi-layer circuit board. In addition, the ring-shaped conductor structure may also be treated as a support structure supporting the air cavity SA.

Furthermore, the waveguide structure 100*a* in the present embodiment may further include a plurality of conductive vias T disposed on two opposite sides of the air cavity SA and penetrating through the first build-up circuit layer 126*a*, the first insulation layer 132*a*, the first inner circuit layer 122*a*, the dielectric layer 110*a*, the second inner circuit layer 124*a*, the second insulation layer 134*a*, and the second build-up circuit layer 128*a*. The conductive vias are structurally and electrically connect the first build-up circuit layer 126*a*, the first inner circuit layer 122*a*, the second inner circuit layer 124*a*, and the second build-up circuit layer 128*a*. As shown in FIG. 1B, the conductive via T connects the air cavity SA and the support structure of the air cavity SA, so that the conductors (that is, the first build-up circuit layer 126*a*, the second build-up circuit layer 128*a*, and the conductor connection layer 140*a*) in the waveguide structure 100*a* have the same potential reference plane (that is, a common ground plane) to maintain signal transmission.

In addition, the waveguide structure 100*a* further includes feed points F1 and F2. Signals may be transmitted into the waveguide structure 100*a* through the feed points F1 and F2. For example, low losses may be implemented by using air in the air cavity SA as a medium through electromagnetic feed transmission, antenna wireless transmission, or by integrating a plurality of transmission manners.

From another perspective, referring to FIG. 1C, the first insulation layer 132*a* and the second insulation layer 134*a* in the present embodiment are located on the first surface 111*a* and the second surface 113*a* of the dielectric layer 110*a* respectively. The first build-up circuit layer 126*a* and the second build-up circuit layer 128*a* cover the first insulation layer 132*a* and the second insulation layer 134*a*, respectively 134*a*. The first insulation layer 132*a* extends to cover a first part B1 of the opening 112*a* located between the first inner-layer circuit layer 122*a* and the first build-up circuit layer 126*a*. The second insulation layer 134*a* extends to cover a second part B2 of the opening 112*a* located between the second inner circuit layer 124*a* and the second build-up circuit layer 128*a*. The dielectric layer 110*a*, the first insulation layer 132*a* and the first build-up circuit structure 126*a* covering the first surface 111*a*, and the second insulation layer 134*a* and the second build-up circuit layer 128*a* covering the second surface 113*a* may define a microstrip line portion M1 herein. Through the microstrip line portion M1, signals may be horizontally fed into the air cavity SA. The microstrip line portion may be used for signal transmission.

In terms of a manufacturing process of the waveguide structure 100*a* in the present embodiment, for example, one or more polymer copper foil substrates or polymer materials and metal copper foil may be etched, plated, and pressed by using a printed circuit board manufacturing process to form a single air cavity SA or more than two air cavities. Since the air cavity SA is formed through pressing, the air cavity SA includes only air. In other embodiments, the air cavity SA may also be a vacuum medium with low losses and without a physical entity.

In short, an empty substrate integrated waveguide (ESIW) structure is implemented for the waveguide structure 100*a* in the present embodiment by using a multi-layer circuit board manufacturing technology. Through the design of the air cavity SA, energy losses during signal transmission may be reduced. In addition, since the waveguide structure 100*a* in the present embodiment features low losses, thermal energy generated by the losses during energy transfer is less than that of other substrate integrated waveguides (SIW). Therefore, when the same material (the same glass transition temperature) is used, the structure may withstand high average signal power and may still remain integrity thereof, indicating that the present embodiment has high average power handling. In addition, because all positions with large signal electromagnetic field strength are encapsulated in the metal structure, signal transmission characteristics are not affected by dielectric materials outside the air cavity SA. In addition, since the waveguide structure 100*a* in the present embodiment is not affected by the dielectric materials outside the air cavity SA, selection of the dielectric materials is relatively flexible.

It needs to be noted herein that in the following embodiments, reference numerals and partial contents of the foregoing embodiments are used. Same reference numerals are used to represent same or similar elements, and descriptions about same technical contents are omitted. For the omitted descriptions, reference may be made to the foregoing embodiments, and the descriptions are omitted herein in the following embodiments.

Figure 2:
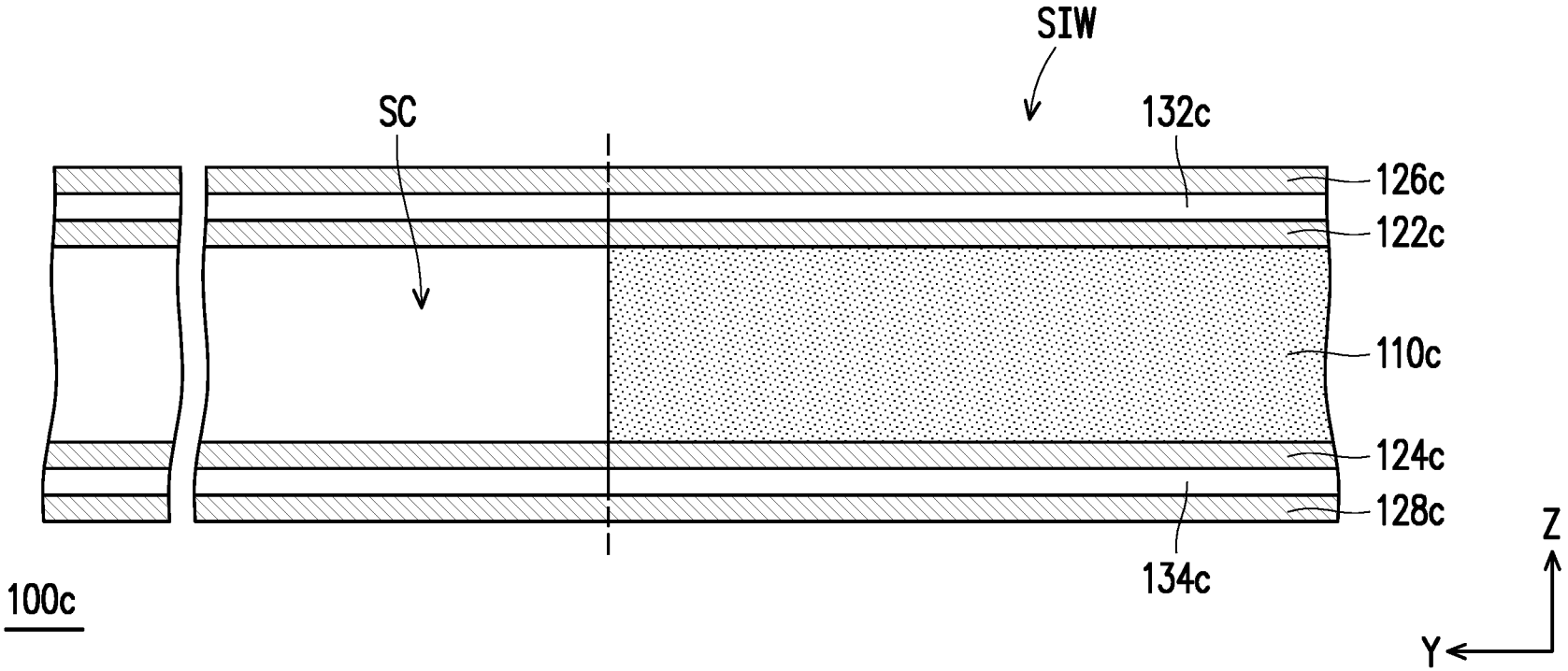
FIG. 2 is a schematic cross-sectional view of a waveguide structure according to another embodiment of the disclosure.

FIG. 2 is a schematic cross-sectional view of a waveguide structure according to another embodiment of the disclosure. Referring to FIG. 1B and FIG. 2 together, a waveguide structure 100*c* in the present embodiment is similar to the waveguide structure 100*a* in FIG. 1B. A difference therebetween lies in that: a dielectric layer 110*c*, a first inner circuit layer 122*c*, a first insulation layer 132*c*, and a first build-up circuit layer 126*c* covering a first surface 111*c*, and a second inner circuit layer 124*c*, a second insulation layer 134*c*, and a second build-up circuit structure 128*c* covering a second surface 113*c* in the present embodiment may define a substrate integrated waveguide SIW portion. Signals may be horizontally fed into the air cavity SC through the substrate integrated waveguide SIW portion, and the SIW portion may be used for signal transmission.

Figure 3A:
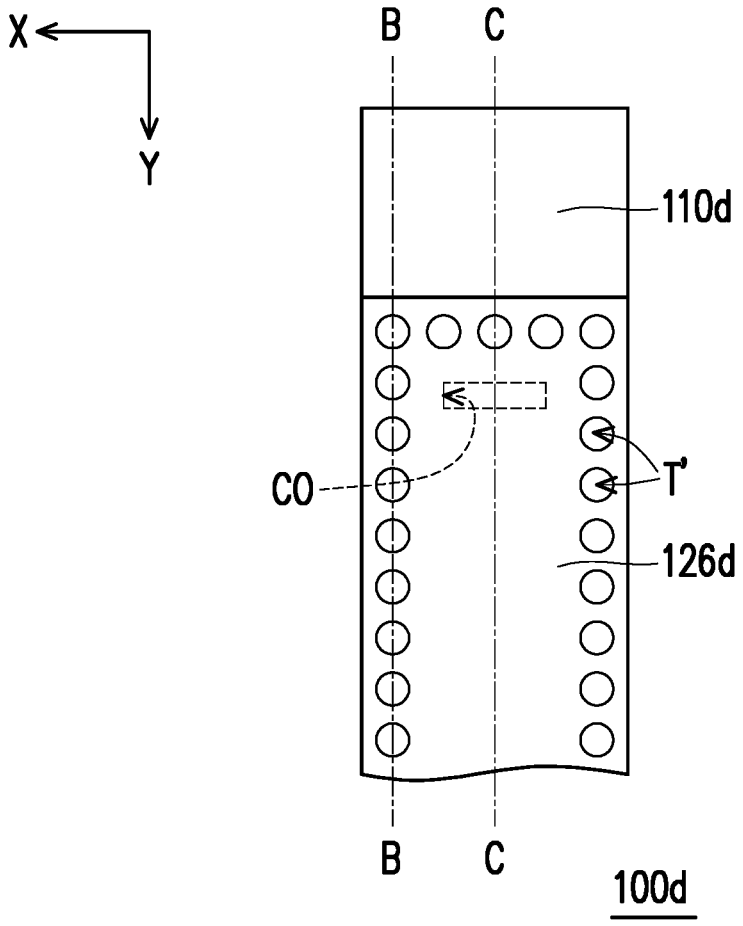
FIG. 3A is a partial schematic top view of a waveguide structure according to another embodiment of the disclosure.

FIG. 3A is a partial schematic top view of a waveguide structure according to another embodiment of the disclosure.

Figure 3B:
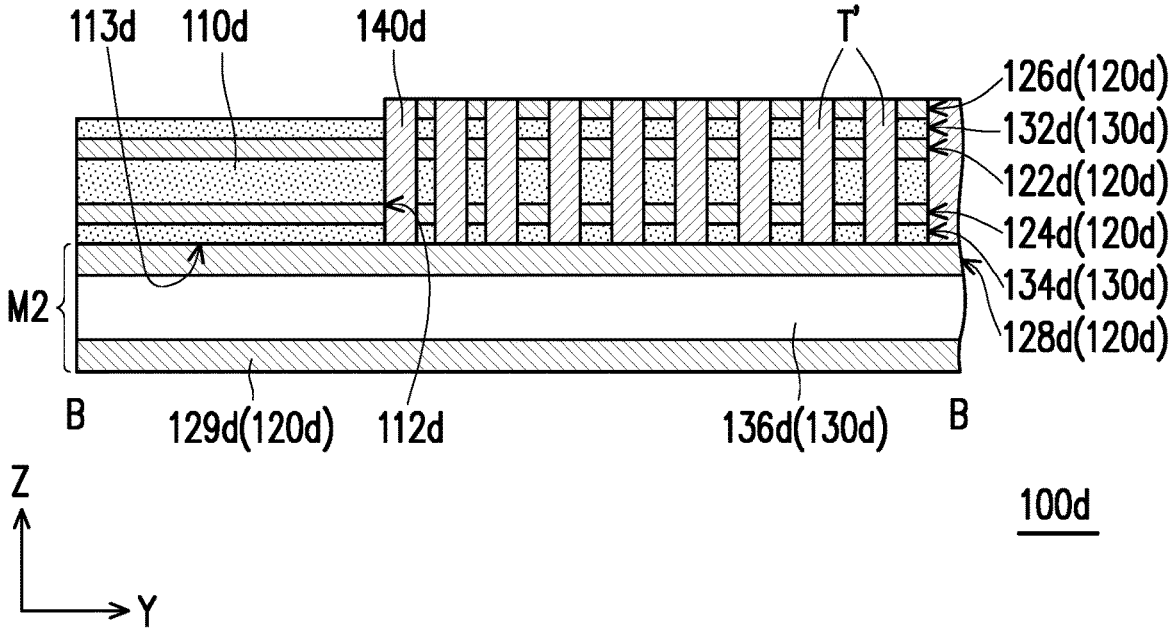
FIG. 3B is a schematic cross-sectional view taken along a line B-B in FIG. 3A.
Figure 3C:
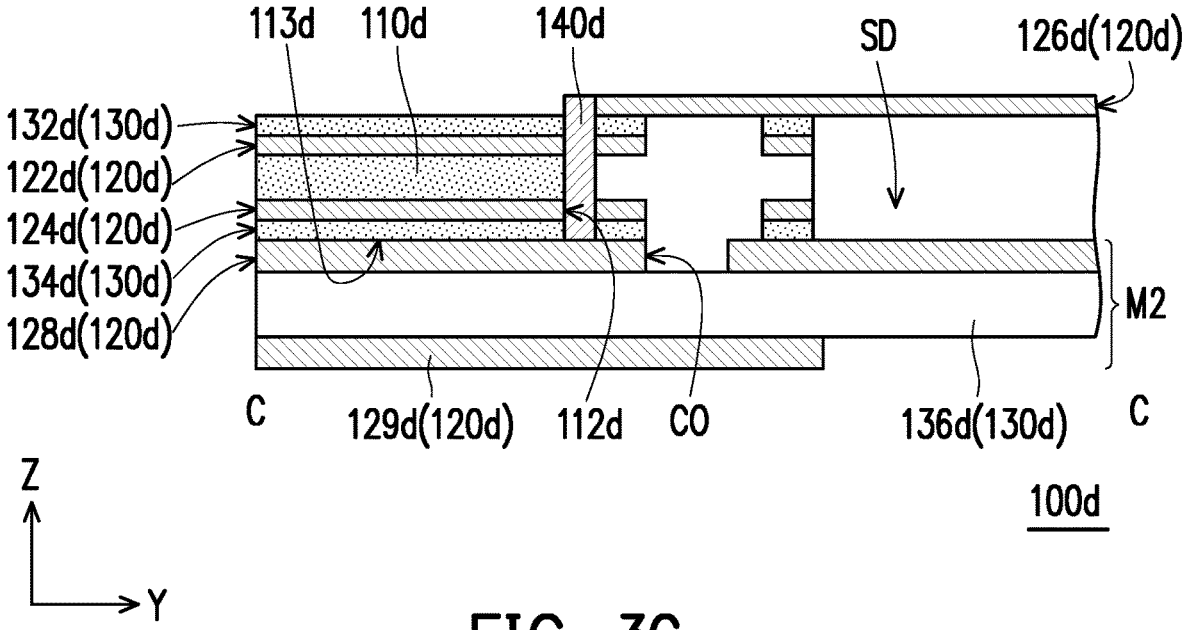
FIG. 3C is a schematic cross-sectional view taken along a line C-C in FIG. 3A.

FIG. 3B is a schematic cross-sectional view taken along line a B-B in FIG. 3A. FIG. 3C is a schematic cross-sectional view taken along a line C-C in FIG. 3A. Referring to FIG. 1A, FIG. 1B, FIG. 1C, FIG. 3A, FIG. 3B, and FIG. 3C together, a waveguide structure 100*d* in the present embodiment is similar to the waveguide structure 100*a* in FIG. 1B. A difference therebetween lies in that: a first insulation layer 132*d* in the present embodiment is located between a first build-up circuit layer 126*d* and a first inner circuit layer 122*d*. A second insulation layer 134*d* is located between a second build-up circuit layer 128*d* and a second inner circuit layer 124*d*. The second build-up circuit layer 128*d* covers a second surface 113*d* of a dielectric layer 110*d* and has a coupling opening CO in communication with an opening 112*e*. A conductor connection layer 140*d* connects the first inner circuit layer 122*d*, the first build-up circuit layer 126*d*, and the second build-up circuit layer 128*d*.

Furthermore, circuit layers 120*d* in the present embodiment further include a third build-up circuit layer 129*d*, and insulation layers 130*d* further include a third insulation layer 136*d*. The third insulation layer 136*d* covers the second build-up circuit layer 128*d*, and the third build-up circuit layer 129*d* covers a part of the third insulation layer 136*d*. The second build-up circuit layer 128*d*, the third insulation layer 136*d*, and the third build-up circuit layer 129*d* define a microstrip line portion M2.

In addition, the waveguide structure 100*d* in the present embodiment further includes a plurality of conductive vias T' disposed around an air cavity SD and penetrating through the first build-up circuit layer 126*d*, the first insulation layer 132*d*, the first inner circuit layer 122*d*, the second inner circuit layer 124*d*, and the second insulation layer 134*d*. The conductive vias T' electrically connect the first build-up circuit layer 126*d*, the first inner circuit layer 122*d*, the second inner circuit layer 124*d*, and the second build-up circuit layer 128*d*. The air cavity SD herein is surrounded by the first build-up circuit layer 126*d* and the second build-up circuit layer 128*d*.

In short, the waveguide structure 100*d* in the present embodiment adopts a multi-layer structure, and transmits signals from the lower microstrip line portion M2 to the upper air cavity SD through the coupling opening CO and/or a conductive via T", and is used for signal transmission.

Figure 4A:
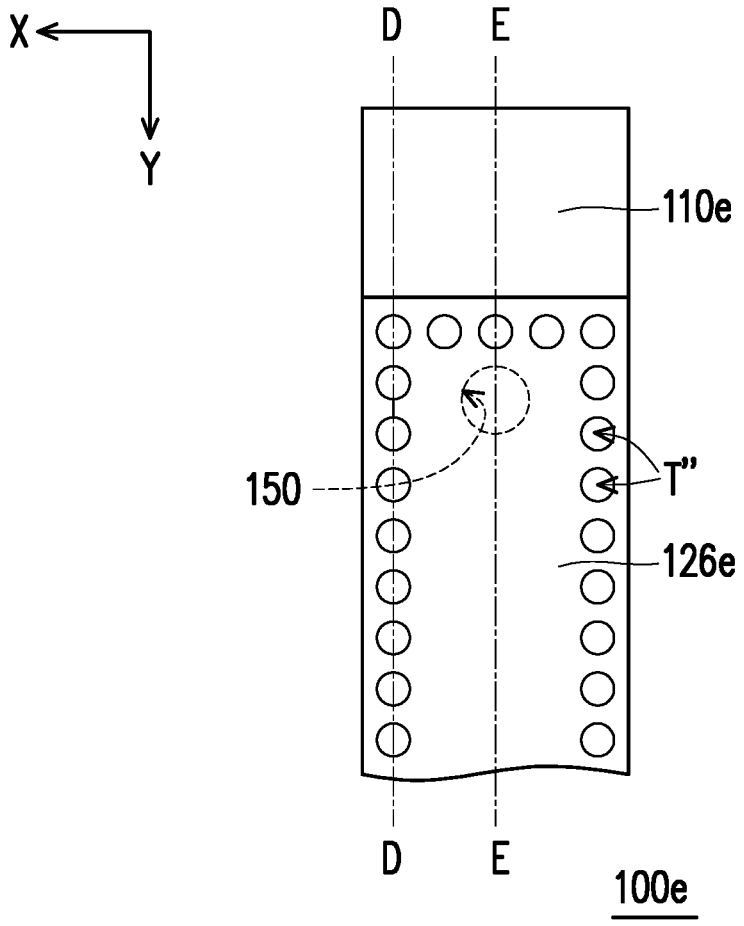
FIG. 4A is a partial schematic top view of a waveguide structure according to another embodiment of the disclosure.
Figure 4B:
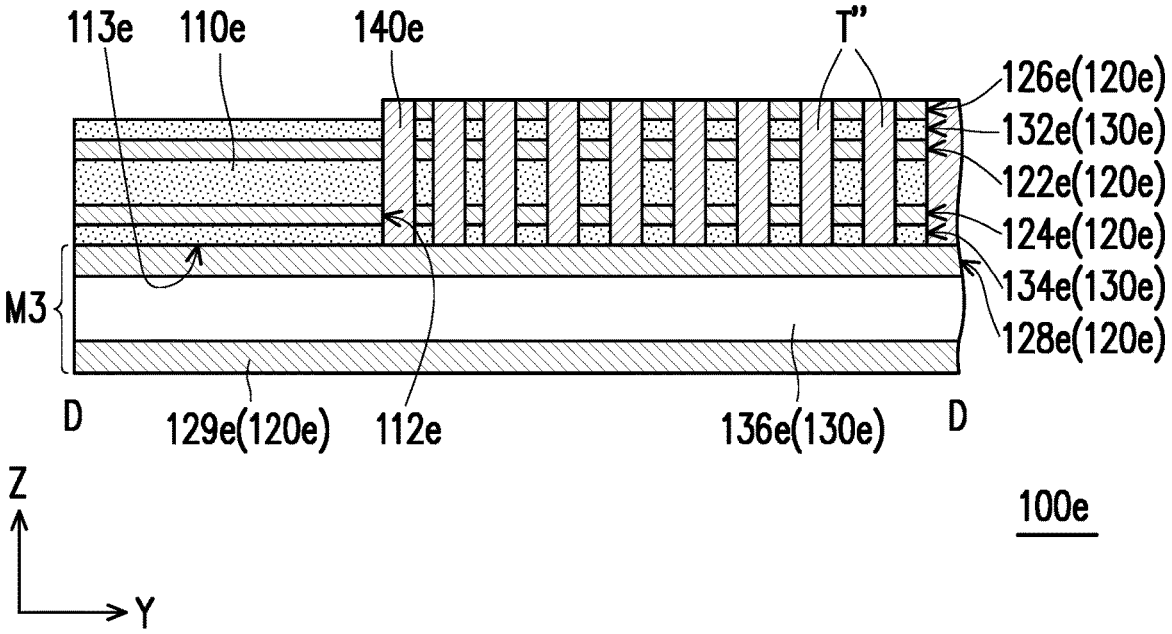
FIG. 4B is a schematic cross-sectional view taken along a line D-D in FIG. 4A.
Figure 4C:
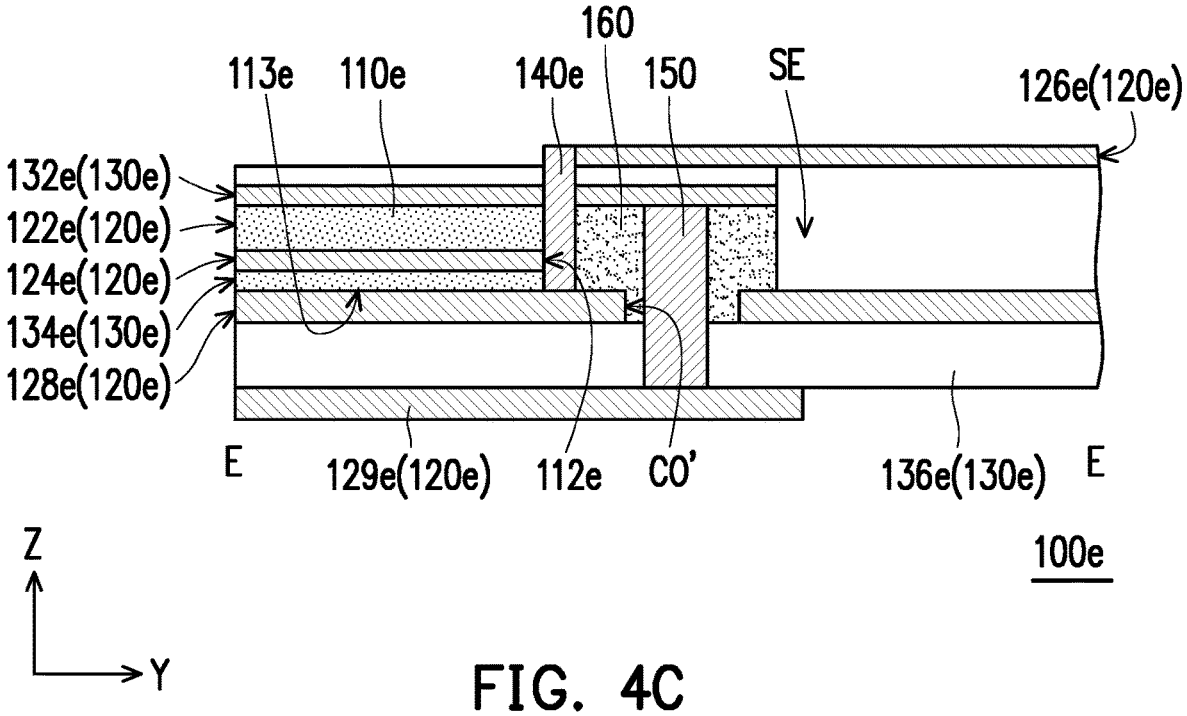
FIG. 4C is a schematic cross-sectional view taken along a line E-E in FIG. 4A.

FIG. 4A is a partial schematic top view of a waveguide structure according to another embodiment of the disclosure. FIG. 4B is a schematic cross-sectional view taken along line a D-D in FIG. 4A. FIG. 4C is a schematic cross-sectional view taken along a line E-E in FIG. 4A. Referring to FIG. 1A, FIG. 1B, FIG. 1C, FIG. 4A, FIG. 4B, and FIG. 4C together, a waveguide structure 100*e* in the present embodiment is similar to the waveguide structure 100*a* in the foregoing embodiment. A difference therebetween lies in that: a first insulation layer 132*e* in the present embodiment is located between a first build-up circuit layer 126*e* and a first inner circuit layer 122*e*. A second insulation layer 134*e* is located between a second build-up circuit layer 128*e* and a second inner circuit layer 124*e*. The second build-up circuit layer 128*e* covers a second surface 113*e* of a dielectric layer 110*e* and has a coupling opening CO' in communication with an opening 112*e*'. A conductor connection layer 140*e* connects the first inner circuit layer 122*e*, the first build-up circuit layer 126*e*, and the second build-up circuit layer 128*e*.

Furthermore, circuit layers 120*e* in the present embodiment further include a third build-up circuit layer 129*e*, and insulation layers 130*e* further include a third insulation layer 136*e*. The third insulation layer 136*e* covers the second build-up circuit layer 128*e*, and the third build-up circuit layer 129*e* covers a part of the third insulation layer 136*e*. The second build-up circuit layer 128*e*, the third insulation layer 136*e*, and the third build-up circuit layer 129*e* define a microstrip line portion M3.

In addition, the waveguide structure 100*e* in the present embodiment further includes a plurality of conductive vias T" disposed around an air cavity SE and penetrating through the first build-up circuit layer 126*e*, the first insulation layer 132*e*, the first inner circuit layer 122*e*, the second inner circuit layer 124*e*, and the second insulation layer 134*e*. The conductive vias T" electrically connect the first build-up circuit layer 126*e*, the first inner circuit layer 122*e*, the second inner circuit layer 124*e*, and the second build-up circuit layer 128*e*. The air cavity SE herein is surrounded by the first build-up circuit layer 126*e* and the second build-up circuit layer 128*e*.

In addition, the waveguide structure 100*e* in the present embodiment may further include a feed portion 150 and a protective layer 160. The feed portion 150 penetrates through the third insulation layer 129*e* and passes through the coupling opening CO' to electrically connect the first inner circuit layer 122*e* and the third build-up circuit layer 129*e*. The protective layer 160 covers a surrounding surface of the feed portion 150, where the feed portion 150 is electrically insulated from the second build-up circuit structure 128*e* through the protective layer 160. The protective layer 160 and the dielectric layer 110*e* herein may be made of the same material or different materials.

In short, the waveguide structure 100*e* in the present embodiment adopts a multi-layer structure, and transmits signals from the lower microstrip line portion M3 to the upper air cavity SE through the coupling opening CO and/or the feed portion 150 and/or the conductive via T", and is used for signal transmission.

Figure 5A:
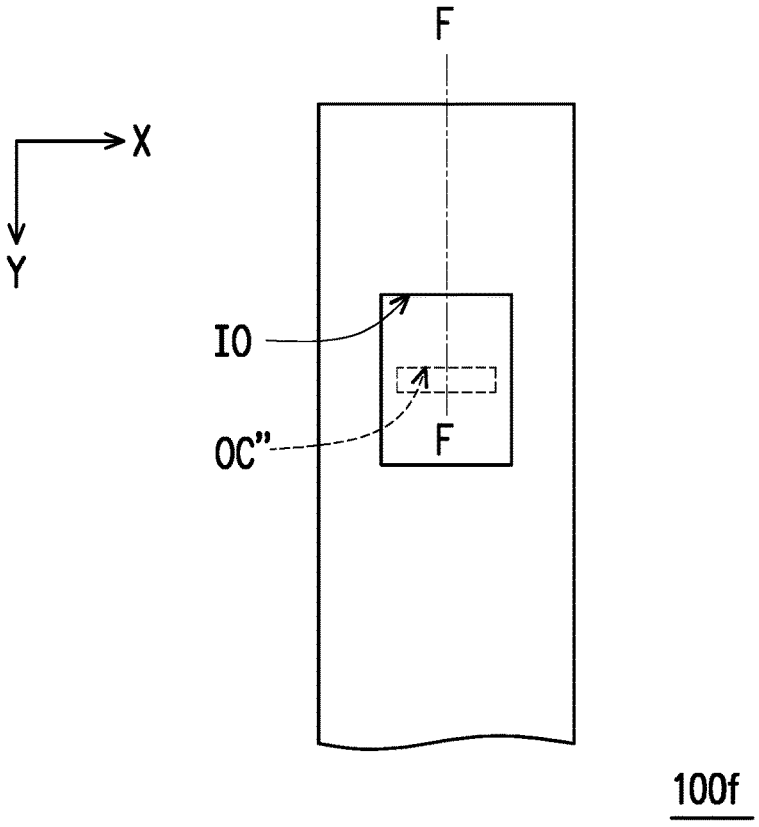
FIG. 5A is a partial schematic top view of a waveguide structure according to another embodiment of the disclosure.
Figure 5B:
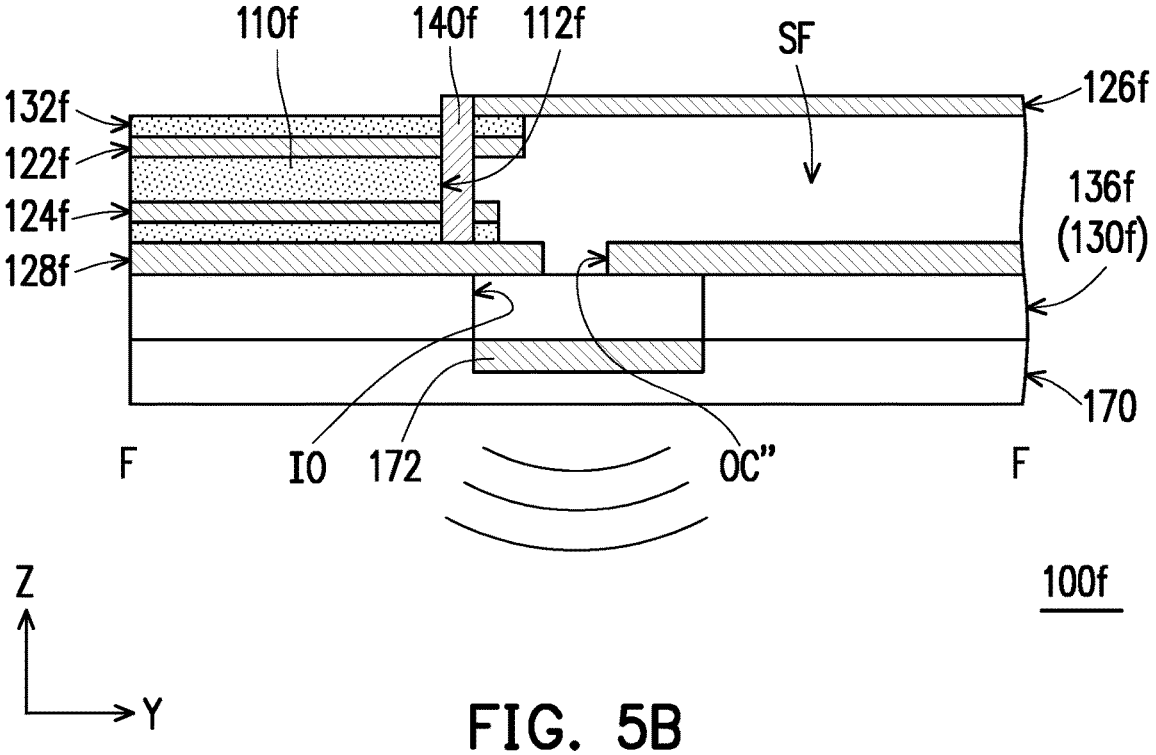
FIG. 5B is a schematic cross-sectional view taken along a line F-F in FIG. 5A.

FIG. 5A is a partial schematic top view of a waveguide structure according to another embodiment of the disclosure. FIG. 5B is a schematic cross-sectional view taken along a line F-F in FIG. 5A. Referring to FIG. 3A, FIG. 3C, FIG. 5A, and FIG. 5B together, a waveguide structure 100*f* in the present embodiment is similar to the waveguide structure 100*d* in the foregoing embodiment. A difference therebetween lies in that: the waveguide structure 100*f* in the present embodiment further includes an antenna element 170. The antenna element 170 includes at least one antenna element 172. The antenna element 172 is, for example, a patch antenna, but the disclosure is not limited thereto. Insulation layers 130*f* further include a third insulation layer 136*f* covering a second build-up circuit layer 128*f* and having an insulation opening IO in communication with an opening 112*f* and a coupling opening OC". The antenna assembly 170 covers the third insulation layer 136*f*, and the antenna element 172 is disposed corresponding to the insulation opening IO. A conductor connection layer 140*f* covering an inner wall of the opening 112*f* of a dielectric layer 110*f* connects a first inner circuit layer 122*f*, a first build-up circuit layer 126*f*, a second inner circuit layer 124*f*, and a second build-up circuit layer 128*f*.

In short, the waveguide structure 100*f* in the present embodiment reduces energy losses during signal transmission through an air cavity SF, the coupling opening OC", and the insulation opening IO in communication with each other. The air cavity SF herein is surrounded by the first build-up circuit layer 126*f* and the second build-up circuit layer 128*f*. In addition, the waveguide structure 100*f* in the present embodiment integrates an empty substrate integrated waveguide (ESIW) structure and an antenna structure, facilitating high-frequency and high-speed transmission applications such as 5G.

It is worth mentioning that, in other embodiments that are not shown, a surface processing procedure may be performed on surfaces of the circuit layer and the conductor connection layer relatively away from the air cavity. For example, surface processing may be performed in a chemical (for example, gold or palladium gold), electroplating (for example, gold plating or silver plating) or physical (for example, sand blasting) manner, to reduce surface roughness (for example, Rz) of a metal conductor, so that antioxidant performance may be enhanced.

In view of the foregoing, the waveguide structure of the disclosure includes the dielectric layer, the plurality of circuit layers, the plurality of insulation layers, and the conductor connection layer. The dielectric layer, the plurality of circuit layers, and the plurality of insulation layers may be treated as a multi-layer circuit board, and at least the conductor connection layer and a part of the circuit layer may define the air cavity for transmitting signals at a position corresponding to the opening of the dielectric layer. Through the design of the air cavity, energy losses during signal transmission may be reduced. Therefore, the waveguide structure of the disclosure not only features low losses but also has high average power handling and is not affected by dielectric materials outside the air cavity.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims. Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A waveguide structure, comprising:

a dielectric layer comprising an opening;

a plurality of circuit layers disposed on the dielectric layer;

a plurality of insulation layers alternately stacked with the circuit layers; and a conductor connection layer covering an outer wall of the opening in a direction perpendicular to the circuit layers and connecting at least two of the circuit layers located on two opposite sides of the dielectric layer, wherein at least the conductor connection layer and a part of the circuit layers define an air cavity for transmitting signals at a position corresponding to the opening, wherein the dielectric layer comprises a first surface and a second surface opposite to each other, the circuit layers comprise a first inner circuit layer, a second inner circuit layer, a first build-up circuit layer, and a second build-up circuit layer, the insulation layers comprise a first insulation layer and a second insulation layer, and the conductor connection layer connects the first inner circuit layer and the second inner circuit layer, wherein the first inner circuit layer is disposed on the first surface of the dielectric layer, the first insulation layer is located between the first build-up circuit layer and the first inner circuit layer, the first insulation layer comprises a first opening in communication with the opening, the second inner circuit layer is disposed on the second surface of the dielectric layer, the second insulation layer is located between the second build-up circuit layer and the second inner circuit layer, the second insulation layer comprises a second opening in communication with the opening, an inner wall of the first opening and an inner wall of the second opening are flush with the conductor connection layer, the first build-up circuit layer extends to cover the first opening, the second build-up circuit layer extends to cover the second opening, and a part of the first build-up circuit layer, the inner wall of the first opening, the conductor connection layer, the inner wall of the second opening, and a part of the second build-up circuit layer defines the air cavity.

2. The waveguide structure according to claim 1, further comprising:

a plurality of conductive vias disposed on two opposite sides of the air cavity and penetrating through the first build-up circuit layer, the first insulation layer, the first inner circuit layer, the dielectric layer, the second inner circuit layer, the second insulation layer, and the second build-up circuit layer, wherein the conductive vias electrically connect the first build-up circuit layer, the first inner circuit layer, the second inner circuit layer, and the second build-up circuit layer.

3. A waveguide structure, comprising:

a dielectric layer comprising an opening;

a plurality of circuit layers disposed on the dielectric layer;

a plurality of insulation layers alternately stacked with the circuit layers; and a conductor connection layer covering an outer wall of the opening in a direction perpendicular to the circuit layers and connecting at least two of the circuit layers located on two opposite sides of the dielectric layer, wherein at least the conductor connection layer and a part of the circuit layers define an air cavity for transmitting signals at a position corresponding to the opening, wherein the dielectric layer comprises a first surface and a second surface opposite to each other, the circuit layers comprise a first inner circuit layer, a second inner circuit layer, a first build-up circuit layer, and a second build-up circuit layer, the insulation layers comprise a first insulation layer and a second insulation layer, and the conductor connection layer connects the first inner circuit layer and the second inner circuit layer, wherein the first insulation layer and the second insulation layer are located on the first surface and the second surface of the dielectric layer, respectively, the first build-up circuit layer and the second build-up circuit layer cover the first insulation layer and the second insulation layer, respectively, the first insulation layer extends to cover a first part of the opening located between the first inner circuit layer and the first build-up circuit layer, the second insulation layer extends to cover a second part of the opening located between the second inner circuit layer and the second build-up circuit layer, and a part of the first build-up circuit layer, a part of the second build-up circuit layer, and the conductor connection layer define the air cavity.

4. The waveguide structure according to claim 1, wherein the first insulation layer is located between the first build-up circuit layer and the first inner circuit layer, the second insulation layer is located between the second build-up circuit layer and the second inner circuit layer, the second build-up circuit layer covers the second surface of the dielectric layer and comprises a coupling opening in communication with the opening, and the conductor connection layer connects the first inner circuit layer, the first build-up circuit layer, and the second build-up circuit layer.

5. The waveguide structure according to claim 4, wherein the circuit layers further comprise a third build-up circuit layer, and the insulation layers further comprise a third insulation layer, the third insulation layer covers the second build-up circuit layer, the third build-up circuit layer covers a part of the third insulation layer, and the second build-up circuit layer, the third insulation layer, and the third build-up circuit layer define a microstrip line portion.

6. The waveguide structure according to claim 5, further comprising:

a plurality of conductive vias disposed around the air cavity and penetrating through the first build-up circuit layer, the first insulation layer, the first inner circuit layer, the second inner circuit layer, and the second insulation layer, wherein the conductive vias electrically connect the first build-up circuit layer, the first inner circuit layer, the second inner circuit layer, and the second build-up circuit layer.

7. The waveguide structure according to claim 5, further comprising:

a feed portion penetrating through the third insulation layer and passing through the coupling opening to electrically connect the first inner circuit layer and the third build-up circuit layer; and a protective layer covering a surrounding surface of the feed portion, wherein the feed portion is electrically insulated from the second build-up circuit layer through the protective layer.

8. The waveguide structure according to claim 4, further comprising:

an antenna assembly comprising at least one antenna element, wherein the insulation layers further comprise a third insulation layer, the third insulation layer covers the second build-up circuit layer and comprises an insulation opening in communication with the opening and the coupling opening, the antenna assembly covers the third insulation layer, the antenna element is disposed corresponding to the insulation opening, and the conductor connection layer connects the first inner circuit layer, the first build-up circuit layer, the second inner circuit layer, and the second build-up circuit layer.

* * * * *